US007234655B2

(12) United States Patent
Umeda et al.

(10) Patent No.: US 7,234,655 B2
(45) Date of Patent: Jun. 26, 2007

(54) TRAVEL CONTROL DEVICE FOR SELF-PROPELLED RECYCLE MACHINE

(75) Inventors: Hiroyuki Umeda, Hirakata (JP); Noriyuki Yoshida, Hirakata (JP)

(73) Assignee: Komatsu Ltd., Tokyo (JP)

( * ) Notice: Subject to any disclaimer, the term of this patent is extended or adjusted under 35 U.S.C. 154(b) by 3 days.

(21) Appl. No.: 10/545,554

(22) PCT Filed: Oct. 21, 2004

(86) PCT No.: PCT/JP2004/015613

§ 371 (c)(1),
(2), (4) Date: Aug. 12, 2005

(87) PCT Pub. No.: WO2005/037437

PCT Pub. Date: Apr. 28, 2005

(65) Prior Publication Data

US 2006/0144974 A1 Jul. 6, 2006

(30) Foreign Application Priority Data

Oct. 22, 2003 (JP) ..... 2003-361350

(51) Int. Cl.
*B02C 25/00* (2006.01)
*B02C 4/32* (2006.01)
*B02B 5/02* (2006.01)

(52) U.S. Cl. ..... 241/30; 241/36; 241/101.74

(58) Field of Classification Search ..... 241/30, 241/36, 101.71–101.77
See application file for complete search history.

(56) References Cited

U.S. PATENT DOCUMENTS

2005/0173570 A1* 8/2005 Tanaka et al. ..... 241/36

FOREIGN PATENT DOCUMENTS

| | | | |
|---|---|---|---|
| JP | 8-57344 | A | 3/1996 |
| JP | 11-156226 | A | 6/1999 |
| JP | 2001-121022 | A | 5/2001 |
| JP | 2002-086008 | A | 3/2002 |
| JP | 2002-192010 | A | 7/2002 |

OTHER PUBLICATIONS

International Preliminary Report on Patentability (IPRP), Chapter I of the Patent Cooperation Treaty for PCT/JP2004/015613, 4 sheets.
International Preliminary Report on Patentability (IPRP) and Written Opinion in English, Chapter I of the Patent Cooperation Treaty for PCT/JP2004/015613, 4 sheets.

* cited by examiner

*Primary Examiner*—Faye Francis
(74) *Attorney, Agent, or Firm*—Frishauf, Holtz, Goodman & Chick, P.C.

(57) ABSTRACT

A travel control device of a self-propelled recycle machine includes: a mode selection means 25 adapted to select a work mode and a travel mode; a travel operation means for operating a drive of a base carrier, and a controller for controlling drives of the base carrier and a crusher or a soil improvement machine, the controller including: a mode judging means 611 for judging a mode selected by the mode selection means; a travel operation signal detecting means 613 for detecting a travel operation signal from the travel operation means; and a work mode control means 614 for controlling the drive of the base carrier, when it is judged that the work mode is selected and when the travel operation signal is detected, based on the travel operation signal while driving the crusher or the soil improvement machine.

17 Claims, 15 Drawing Sheets

FIG. 9

| MODE | WIRED BOX ENABLING SWITCH | TRAVEL SPEED SELECTION | SPEED COMMAND CURRENT |
|---|---|---|---|
| WORK | OFF | ONLY "Mi" AVAILABLE | $I_3$ |
| | ON | ALL UNAVAILABLE | $I_0$ |
| TRAVEL | OFF | Hi | $I_4$ |
| | | Mi | $I_2$ |
| | | Lo | $I_1$ |
| | ON | ONLY "Lo" AVAILABLE | $I_1$ |
| CHECK | OFF | ALL UNAVAILABLE | $I_0$ |
| | ON | ALL UNAVAILABLE | $I_0$ |

TRAVEL CONTROL DEVICE FOR SELF-PROPELLED RECYCLE MACHINE

TECHNICAL FIELD

This application is a U.S. National Phase Application under 35 USC 371 of International Application PCT/JP2004/015613 filed Oct. 21, 2004.

The present invention relates to a travel control device of a self-propelled recycle machine such as a self-propelled wood crusher and a self-propelled soil improvement machine.

BACKGROUND ART

There is a demand for recycling discarded woods on a work site by, for instance, recycling wood chips produced by crushing cut woods and waste woods from abandoned houses due to considerations on an environment of a surrounding area, a prohibition against a controlled burn and the like, where a wood crusher having a rotation tub is often used.

For instance, there has been known a wood crusher disclosed in Patent Publication 1, and FIG. 15 illustrates the wood crusher disclosed in the Publication 1.

In FIG. 15, a wood crusher 71 includes: a crusher 73 disposed on one side in a longitudinal direction of a platform having a traveling device 75, the crusher 73 having a rotation shaft in the longitudinal direction of the platform; and a tub 72 mounted above the crusher 73 in a manner rotatable around a substantially vertical axis for feeding a fed wood to be crushed to the crusher 73.

A fixed hopper for guiding the fed wood to be crushed to the tub 72 is provided on an upper opening of the tub 72, and a scatter proof cover 77 is provided on the fixed hopper for preventing scattering of wood pieces in a manner openable/closable in a vertical direction.

A engine room 78 on which an engine, hydraulic equipment and the like are mounted is provided on the other side of the platform in the longitudinal direction, and a travel control section 76 for a travel operation of the wood crusher 71 is located between the tub 72 and the engine room 78.

A conveyor 74 for discharging crushed wood chips outside a vehicle is located below the crusher 73.

A control panel 79 for commanding start/stop of the crusher 73, the conveyor 74 and the like is provided below the travel control section 76.

A loader 81 for feeding the wood to be crushed in a feed port of the fixed hopper has a transmitter 82, where command signals of start/stop switches for various working machines provided on the transmitter 82 are received by a receiver antenna 83 on the wood crusher 71, so that a control device (not shown) provided on the wood crusher 71 can control the tub 72, the crusher 73, the conveyor 74 and the like.

In such wood crusher 71, various operations are usually performed based on a work mode including, for instance, a travel mode and a work mode.

An operator can move the vehicle on the travel control section 76 in the travel mode, while the operator can drive the various working machines such as the tub 72, the crusher 73 and the conveyor 74 for crushing work in the work mode.

[Patent Publication 1] Japanese Laid-Open Patent Publication No. 2002-192010 (page 2 and FIG. 2).

DISCLOSURE OF THE INVENTION

PROBLEMS TO BE SOLVED BY THE INVENTION

In the wood crusher 71 having the rotation tub 72 described above, the crushed wood chips, wood to be crushed and the like sometimes scatter to pop out from the upper opening due to the rotation of the crusher 73.

A part of the scattering objects that cannot be prevented even by the scatter proof cover 77 disposed on the upper opening of the tub 72 in a scattering direction of the scattering objects scatters out from the upper opening of the tub 72, which sometimes reaches an area close to the travel control section 76 and the control panel 79.

Thus, in order not to allow the operator to come close to the travel control section 76 or the control panel 79 during the crushing work, a drive operation of the working machines in the work mode is performed under a condition where an operator in an operation room of the loader 81 wirelessly performs the operation using the transmitter 82 or where an operator at the control panel 79 disposed on either one end in a width direction of the platform performs the operation before feeding the wood to be crushed and then leaves the control panel, while only the travel operation is allowed to be performed from the travel control section 76 during the travel mode.

However, such operation system causes an inconvenience as follows. During the crushing work, when the wood chips discharged to the ground below a tip end of the conveyor 74 are piled up to a height contacting the tip end of the conveyer 74, the piled wood chips have to be forked out by the loader or the wood crusher 71 has to be moved in a posterior-anterior direction or in a right-left direction for preventing clogging of discharged objects to enhance discharge efficiency.

The former requires intermitting a loading operation for loading the wood to be crushed on the wood crusher 71 by the loader 81 to move the loader 81, while the latter requires intermitting the crushing work to move and displace the wood crusher 71 by a predetermined distance in the travel mode and then restarting the crushing work in the work mode, which results in lowering efficiency of the crushing work.

In view of the problem described above, an object of the present invention is to provide a travel control device of a self-propelled recycle machine (crusher, soil improvement machine, etc.) capable of traveling in a work mode.

MEANS FOR SOLVING THE PROBLEMS

In order to achieve the object, a first invention is a travel control device of a self-propelled recycle machine that has a platform having a base carrier and that has a crusher or a soil improvement machine disposed on the platform, the travel control device including:

a mode selection means adapted to select a work mode for driving the crusher or the soil improvement machine to perform a crushing work or a soil improving work and a travel mode for driving the base carrier to travel;

a travel operation means for operating the drive of the base carrier; and a controller for controlling the drives of the base carrier and the crusher or the soil improvement machine, in which the controller includes:

a mode judging means for judging the mode selected by the mode selection means;

a travel operation signal detecting means for detecting a travel operation signal from the travel operation means; and a work mode control means that, when the mode judging means judges that the work mode is selected and when the travel operation signal is detected by the travel operation signal detecting means, controls the drive of the base carrier based on the travel operation signal while driving the crusher or the soil improvement machine.

A second invention is the travel control device of the self-propelled recycle machine according to the first invention, in which the self-propelled recycle machine includes a feeder for feeding an object to be crushed to the crusher or a feeder for feeding a soil to be recycled to the soil improvement machine, and the controller includes a feed regulating means for regulating a drive of the feeder when the mode judging means judges that the work mode is selected and when the travel operation signal detecting means detects the travel operation signal.

A third invention is the travel control device of the self-propelled recycle machine according to the second invention, in which the self-propelled recycle machine includes downstream equipment provided on a downstream of the crusher or the soil improvement machine (Translator's comment: hereinafter "downstream" means a subsequent stage of the crusher or the soil improvement machine), and the controller includes a continuous operation control means for continuously running the crusher or the soil improvement machine and the downstream equipment when the travel operation signal detecting means detects the travel operation signal during the work of the crusher or the recycle machine.

A fourth invention is the travel control device of the self-propelled recycle machine according to the second or third invention, the travel control device further including a feeder starting means for commanding to start the feeder, in which the controller includes a restart executing means for detecting an input of a start signal from the feeder starting means and restarting the feeder when the mode judging means judges that the work mode is selected and when the travel operation signal detecting means detects that an input of the travel operation signal is stopped.

A fifth invention is the travel control device of the self-propelled recycle machine according to any one of the first through fourth inventions, in which the travel operation means includes a transmission output section for wirelessly transmitting the travel operation signal to the controller.

A sixth invention is the travel control device of the self-propelled recycle machine according to the fifth invention, the travel control device further including a wired operation means provided separately from the travel operation means, the wired operation means being connected to the controller via a movable cable for performing a travel operation from a remote position from the controller, in which the controller includes a wired operation signal receiving means for receiving the travel operation signal from the wired operation means only when the mode judging means judges that the travel mode is selected.

A seventh invention is a travel control method of a self-propelled recycle machine for performing a travel control of the self-propelled recycle machine that has a platform having a base carrier and that has a crusher or a soil improvement machine disposed on the platform, the method performed by a travel control device having a mode selection means adapted to select a work mode for driving the crusher or the soil improvement machine to perform a crushing work and a soil improving work and a travel mode for driving the base carrier to travel, a travel operation means for operating the drive of the base carrier, and a controller for controlling the base carrier and the crusher or the soil improvement machine, the method having steps conducted by the controller, the steps including:

a mode judging step for judging a mode selected by the mode selection means;

a travel operation signal detecting step for detecting a travel operation signal from the travel operation means; and a work mode control step for controlling the drive of the base carrier, when it is judged in the mode judging step that the work mode is selected and when the travel operation signal is detected in the travel operation signal detecting step, based on the travel operation signal while driving the crusher or the soil improvement machine.

An eighth invention is the travel control method of the self-propelled recycle machine according to the seventh invention, in which the self-propelled recycle machine includes downstream equipment provided on a downstream of the crusher or the soil improvement machine, and the controller performs a continuous operation control step for continuously running the crusher or the soil improvement machine and the downstream equipment when it is judged that the work mode is selected in the mode judging step and when the travel operation signal is detected in the travel operation signal detecting step.

EFFECT OF THE INVENTION

According to the first or seventh invention, since the work mode control means allows traveling during the work in the work mode, when, for instance, a height of discharged objects from the discharge conveyor becomes too high, a stock position of the discharged objects can be changed by moving the self-propelled recycle machine and moving a tip position of the discharge conveyor, so that, unlike the conventional technology, the operation does not have to be intermitted to move a vehicle in the travel mode or a bank of the discharged objects does not have to be leveled and lowered, thus enhancing workability. Especially, in a case with a tub-type self-propelled wood crusher, it becomes unnecessary to intermit crushing to scrape out the wood to be crushed in the tub, so that work efficiency can be enhanced drastically.

According to the second invention, when traveling is performed in the work mode, the feed regulating means stops the feeder, so that the minimum power can be used for a drive of the traveling, a drive of the crusher or the soil improvement machine and a drive of the discharge conveyor.

With the arrangement, output of power sources of an engine, a hydraulic pump and the like can be appropriately reduced. Especially, in the tub-type self-propelled wood crusher, since the rotation of the tub is stopped to stop feeding the wood to be crushed, power load can be reduced by a drive load of the tub and an increment of a load in operation time of the crusher.

According to the third or eighth invention, since the continuous operation control means continuously runs the crusher or the soil improvement machine and downstream equipment (the discharge conveyor and a secondary, a tertiary conveyor, etc. externally installed) in traveling in the work mode, the crushing work or the soil improving work can be continued only by a start operation of the feeder even when the vehicle is moved, so that the works can be performed efficiently.

Further, the crushed object and recycled soil are discharged normally, so that clogging can be prevented. Especially, in the tub-type self-propelled wood crusher, since all the crushed wood chips are discharged, when the tub is restarted to start feeding the wood to be crushed to the crusher, the crusher can be prevented from receiving excess loading and from clogging.

According to the fourth invention, after the traveling of the vehicle in the work mode is completed, when the feeder is restarted by the operation of a feeder start switch, the feeder can be restarted by the restart executing means, so that a discharge position of the discharge conveyor after moving the vehicle can be securely set.

In addition, an unexpected accidental damage on the equipment (the crusher, the feeder, etc.), which is likely occur when the equipment is automatically started, can be prevented. Especially, in the tub-type self-propelled wood crusher, the wood to be crushed in the tub does not cut into the crusher and destroy bits or the like of the crusher, thus enhancing durability.

According to the fifth invention, since the transmission output section wirelessly transmits the travel operation signal, and by using the travel operation means for the transmission in an operation room of the loader, the operator does not have to come close to the crusher or the soil improvement machine during the crushing work or the soil improving work, which provides an excellent operational performance.

According to the sixth invention, since the wired operation signal receiving means allows traveling in the travel mode using the wired operation means, the operator can perform operation near the vehicle with the surrounding area in sight, which provides a good operation performance. Especially, in the tub-type self-propelled wood crusher, the crushing work is not performed during traveling in the travel mode and the crushed wood chips do not scatter, so that the travel operation using the wired operation means can be performed easily.

BRIEF DESCRIPTION OF DRAWINGS

FIG. 9 is a schematic diagram showing a set speed for each operation mode;

EXPLANATION OF CODES

1: wood crusher; 2: base carrier, 3: platform; 4: tub feeder; 4*a*: upper opening, 5: hopper; 6: scatter proof cover; 7: engine room; 8: crusher; 9: discharge conveyor; 11: controller; 12: receiver; 13: right travel pressure switch; 14: left travel pressure switch; 15: operation panel; 16: right forward solenoid; 17: right reverse solenoid; 18: left forward solenoid; 19: left reverse solenoid; 20: multi-panel; 21: multi-display; 22: operation switch section; 23: travel speed selection switch (feeder starting means); 24*a*, 24*b*: cursor control key; 25: mode selection switch (mode selection means); 26: wired control enabling switch; 27: travel speed control valve; 28: right travel operation valve; 29: left travel operation valve; 30: remote control operation box (travel operation means); 31: transmitter; 32: left forward switch; 32*a*: left forward signal relay; 33: left reverse switch; 33*a*: left reverse signal relay; 34: right forward switch; 34*a*: right forward signal relay; 35: right reverse switch; 35*a*: right reverse signal relay; 36: tub auto-start switch (feeder starting means); 37*a*: alarm; 37*b*: indicator; 38: =tub auto-start switch (feeder starting means); 39: footboard; 40: wired control operation box (wired operation means, travel operation means); 41: engine stop push switch; 42: left forward switch; 43: left reverse switch; 44: right forward switch; 45: right reverse switch; 46: horn push switch; 51: right forward relay; 52: right reverse relay; 53: left forward relay; 54: left reverse relay; 55, 56: power source; 57: relay; 58: relay driving power source; 61: computer; 611: mode judging means; 612: wired operation signal receiving means; 613: operation signal detecting means (travel operation signal detecting means); 614: work mode control means; 615: feed regulating means; 616: restart executing means; 617: continuous operation control means

BEST MODE FOR CARRYING OUT THE INVENTION

An embodiment of the present invention will be described with reference to the attached drawings.

[1] Arrangement of Wood Crusher

Figure 1:
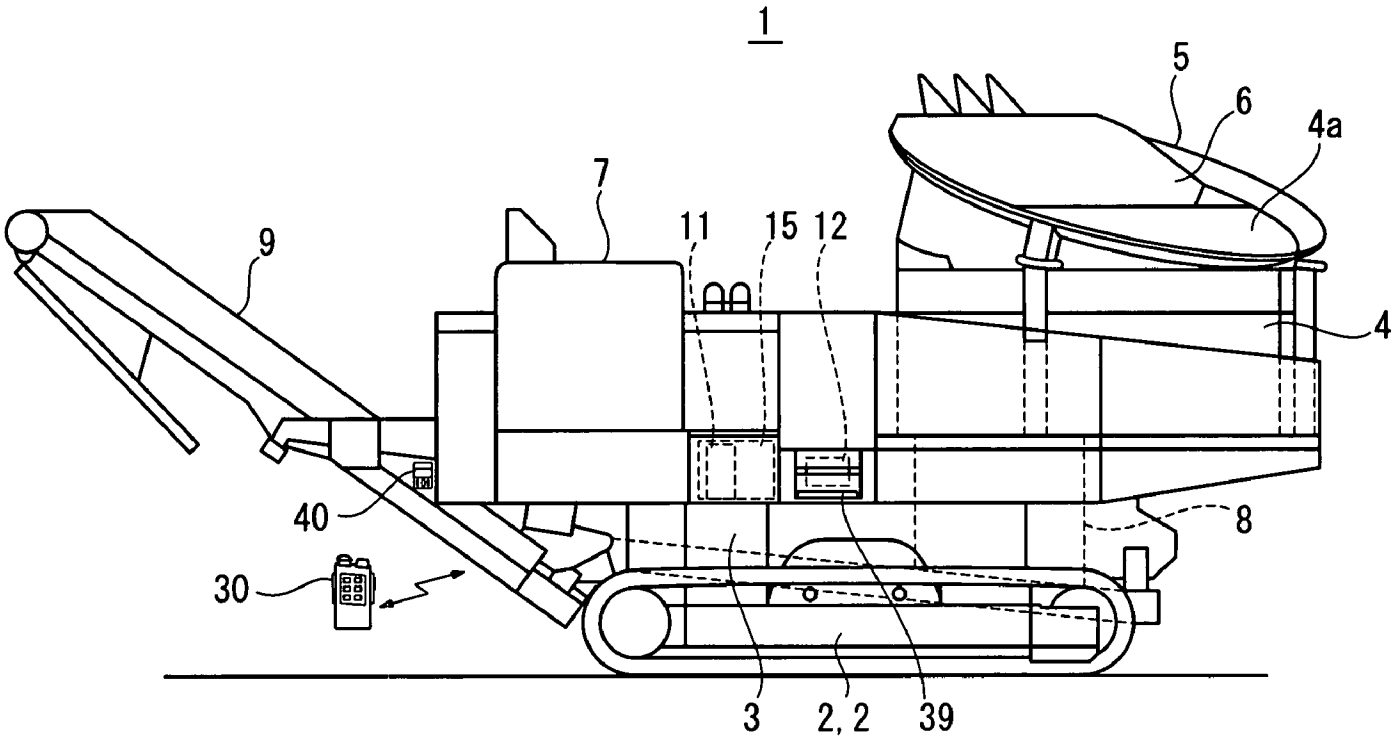
FIG. 1 is a side view of a wood crusher according to the present invention.

FIG. 1 shows a wood crusher 1 according to an embodiment of the present invention, which includes a platform 3 above base carriers 2.

The base carriers 2 are crawler type carriers disposed on both sides of a lower portion of the platform 3, and the wood crusher 1 can move forward (left side in FIG. 1), reverse (right side in FIG. 1) and turn by driving each of the base carriers 2.

The platform 3 has a steel frame, which supports a tub feeder 4, an engine room 7, a crusher 8 and a discharge conveyor 9.

The tub feeder 4 feeds wood to be crushed to the crusher 8, the tub feeder 4 having a cylindrical rotation tub rotatably held on the platform 3. The rotation tub is provided with projections formed at a predetermined pitch on a cylindrical inner peripheral side, and when the rotation tub is rotated, the wood to be crushed fed inside also rotates around a rotation shaft of the rotation tub together to be fed to the crusher 8.

A hopper 5 having a feed port is provided above an upper opening 4*a* of the tub feeder 4, and a scatter proof cover 6 covering substantially half of the upper opening 4*a* of the tub feeder 4 and inclined in a predetermined direction is attached to the hopper 5 in a manner openable/closable.

The crusher 8 is exposed to an opening formed on a bottom portion of the tub feeder 4, the crusher 8 including a rotation shaft connected to a drive source and a rotation drum rotating with the rotation shaft. The rotation drum is a cylindrical metal drum provided with a plurality of bits formed at a predetermined pitch on an outer peripheral side, and when the rotation drum rotates in accordance with the rotation shaft, the plurality of bits collide with the wood to be crushed, and thereby the wood is crushed. The crushed wood chips that are downsized into a size equal to or smaller than a predetermined grain size as the crushing proceeds pass through a screen disposed so as to surround the rotation drum to be discharged.

One end of the discharge conveyor 9 extends toward a lower side of the crusher 8 while the other end thereof extends below the engine room 7 toward the other side in a longitudinal direction of the platform 3, the discharge conveyor 9 is a carrying unit for carrying out the wood chips with the predetermined grain size having been crushed by the crusher 8 and passed through the screen.

The base carrier 2, the tub feeder 4, the crusher 8 and the discharge conveyor 9 included in the wood crusher 1 are actuated by a hydraulic motor as a drive source, and the hydraulic motor as the drive source of the respective devices is driven by an operation oil supplied from the engine room 7.

Although not shown in FIG. 1, the engine room 7 raises the pressure of the operation oil to supply to the hydraulic motor as the drive source of the respective devices, the engine room 7 including an engine for generating power, hydraulic pumps driven by the engine and an operation valve for distributing the pressurized operation oil to respective hydraulic pumps. As the engine is driven, the pressure of the operation oil is raised by the hydraulic pumps, and drives of the respective devices can be controlled by appropriately switching the operation valve through an operator's operation on an operation panel 15.

The operation panel 15 is attached to the platform 3 on a lateral side in a width direction thereof, the operation panel 15 incorporating a controller 11 as a control means. Note that a footboard 39 is provided beside the operation panel 15, and a receiver 12 for receiving a transmission signal from a remote control operation box 30 (described later in detail) is attached on a back side of the footboard 39 (i.e. on an inner side of the vehicle).

A wired control operation box 40 as a travel operation means for operating travel of the vehicle is detachably attached to the platform 3 on a position opposite to the tub feeder 4 in a longitudinal direction (i.e. on a side of the discharge conveyor 9).

The wood crusher 1 further includes the remote control operation box 30 as another travel operation means having a wireless transmitter for wirelessly transmitting a travel switch operation signal. The remote control operation box 30 is used in the operation room of the loader for feeding the wood to be crushed in the tub feeder 4 during the crushing work.

[2] Arrangement of Operation Panel 15

Figure 2:
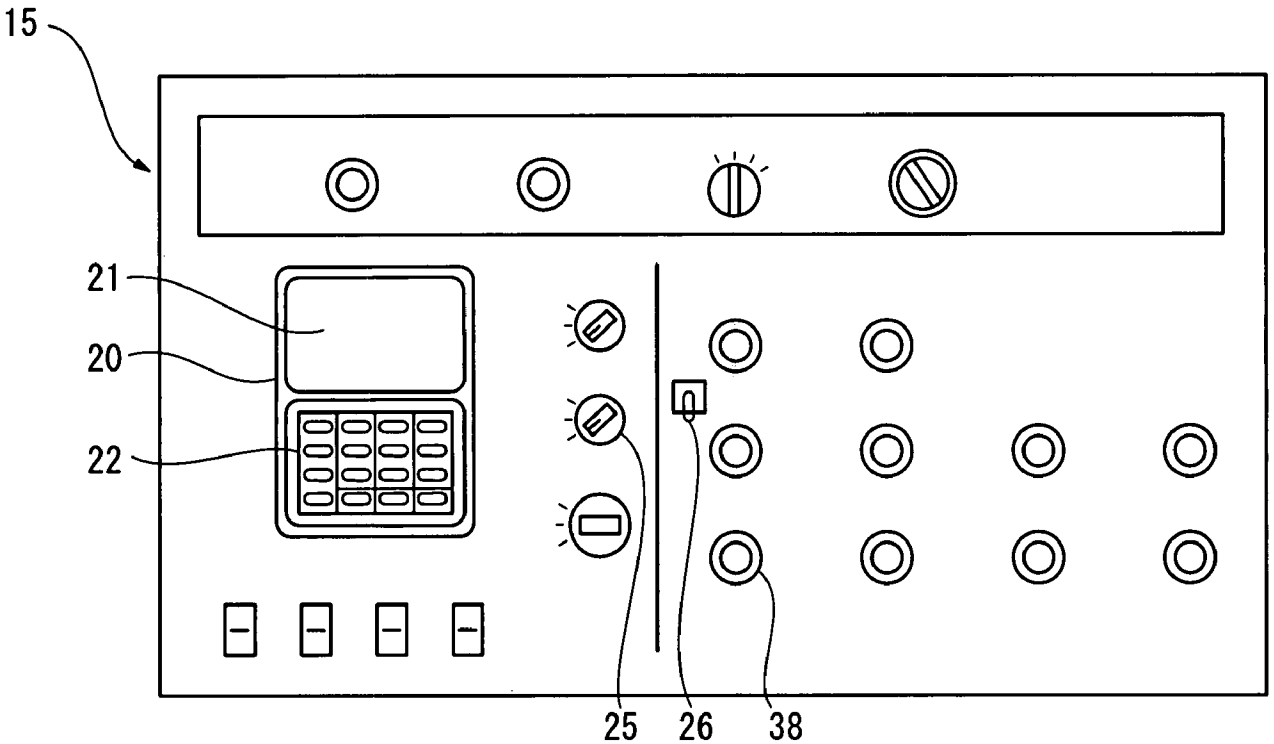
FIG. 2 is a front view of an operation panel according to the present invention.
Figure 3:
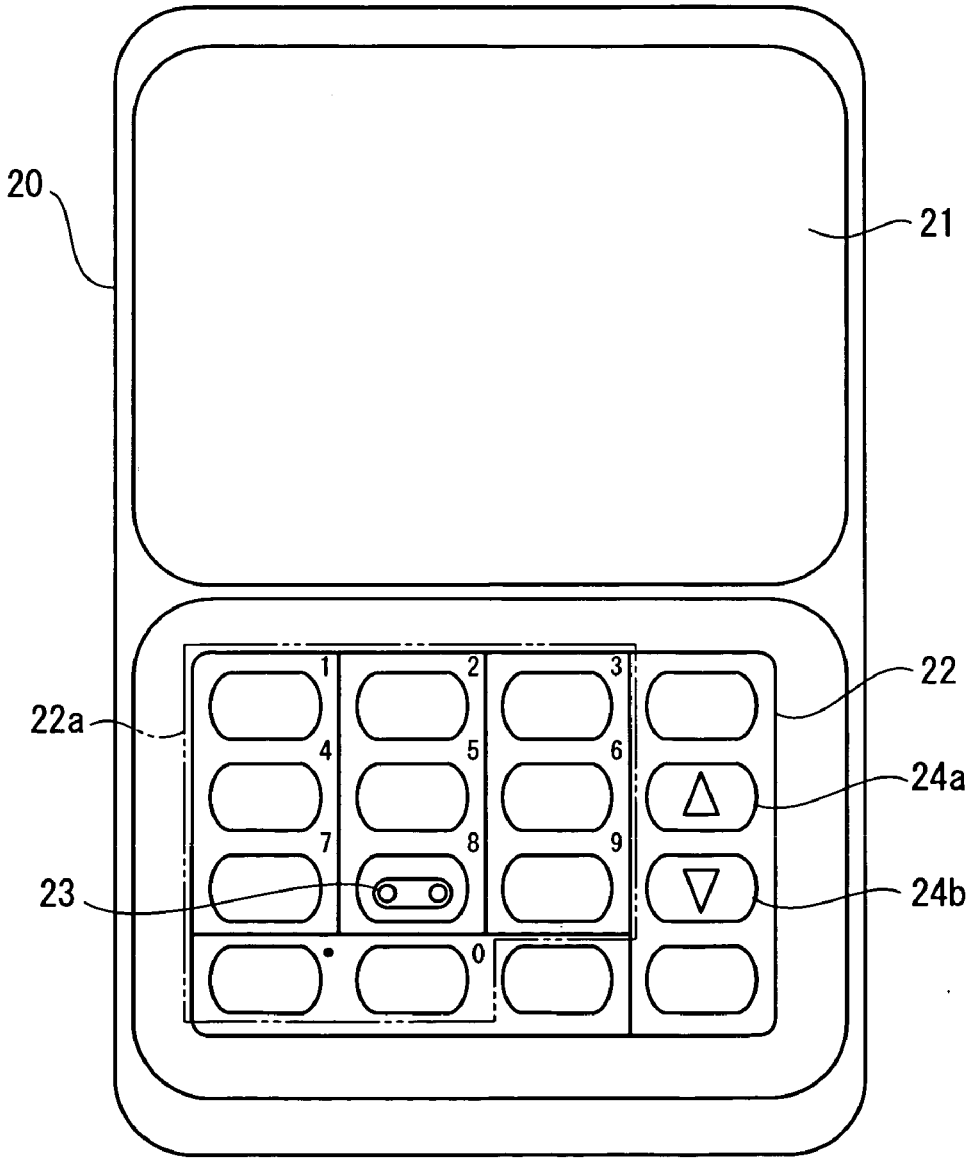
FIG. 3 is a front view of a multi-panel in the operation panel according to the present invention.

Next, the arrangement of the operation panel 15 will be described with reference to FIGS. 2 and 3. FIG. 2 is a front view of the operation panel 15, and FIG. 3 is a front view of a multi-panel in the operation panel 15.

In FIG. 2, in a left panel portion zoned by a line in a vertical direction substantially at the center of the operation panel 15, a multi-panel 20 having a multifunctional display 21 and an operation switch section 22 is provided an upper left side thereof.

On an upper right side of the multi-panel 20, a mode selection switch 25 as a mode selection means and a wired control enabling switch 26 for enabling an operation of the wired control operation box 40 are provided.

Open/close switches for opening/closing the tub feeder 4, the scatter proof cover 6 and the like are provided on a lower side of the left panel portion.

Provided on a right panel portion on the right of the line at the center are an auto-start switch 38 for starting an automatic operation of the tub feeder 4, auto-start switches and stop switches for the discharge conveyor 9, the crusher 8 and the tub feeder 4, a manual normal rotation switch and a reverse rotation switch for the crusher 8 and the tub feeder 4, and the like.

FIG. 3 shows the multi-panel 20 in detail, which is provided with the multi-display 21 formed by a graphic display such as a liquid crystal display or a plasma display, the multi-display 21 displaying a mode being selected, a level corresponding to a load of each of the tub rotation speed and the crusher rotation speed, an alarm indicator for indicating an overloaded portion, and monitoring states of other operations. The operation switch section 22 with variety of switches arranged vertically and horizontally is provided below the multi-panel 20, and eleven switches 22*a* on the left side in the operation switch section 22 each function as a numeric key while functioning as a switch for selection or setting of other functions.

For instance, a switch corresponding to a key "8" functions also as a travel speed selection switch 23. By pressing the switch 23, a travel speed selection window (not shown) is displayed on the display 21, which is so arranged that any one of three indications "Hi", "Mi" and "Lo" displayed on the window is selected by moving a cursor by a cursor control keys "24*a*" and "24*b*" provided on the right side in the operation switch section 22.

[3] Arrangement of Remote Control Operation Box 30/Wired Control Operation Box 40

Figure 4A:
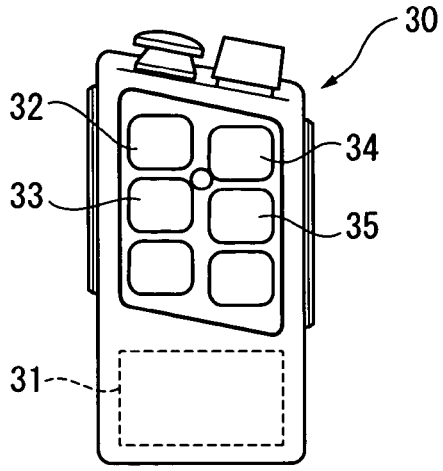
FIG. 4A is an external front view of a remote control operation box according to the present invention.
Figure 4B:
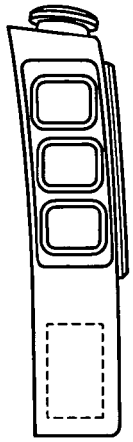
FIG. 4B is an external left side view of the remote control operation box according to the present invention.
Figure 4C:
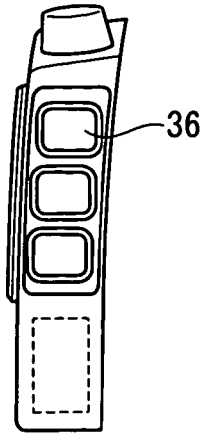
FIG. 4C is an external right side view of the remote control operation box according to the present invention.

FIGS. 4A through 4C are external views of the remote control operation box 30; FIG. 4A is a front view, FIG. 4B is a left side view, and FIG. 4C is a right side view. In FIGS. 4A through 4C, a wireless transmitter 31 is incorporated in the remote control operation box 30.

A total of 6 switches arranged in two (right and left) columns each having three switches are disposed in an area from an upper portion to a middle portion on a front side of the remote control operation box 30, while three switches arranged in one column are respectively provided on a right and a left lateral sides. A left forward switch 32 and left reverse switch 33 are provided on the left in the front side, and a right forward switch 34 and a right reverse switch 35 are provided on the right in the front side.

A tub auto-start switch 36 for starting an automatic operation of the tub feeder 4 is provided on the right lateral side of the remote control operation box 30. Although the reference numerals are not assigned, the other switches each function as an engine stop switch, a tub stop switch, a tub manual reverse rotation switch, a scatter proof cover open/close switch, and the like.

Further, an entire stop switch and a main/remote selection switch are provided on an upper side of the remote control operation box 30. When these switches are operated, the ON/OFF signal is converted into a radio signal by the transmitter 31 and transmitted to the receiver 12.

Figure 5:
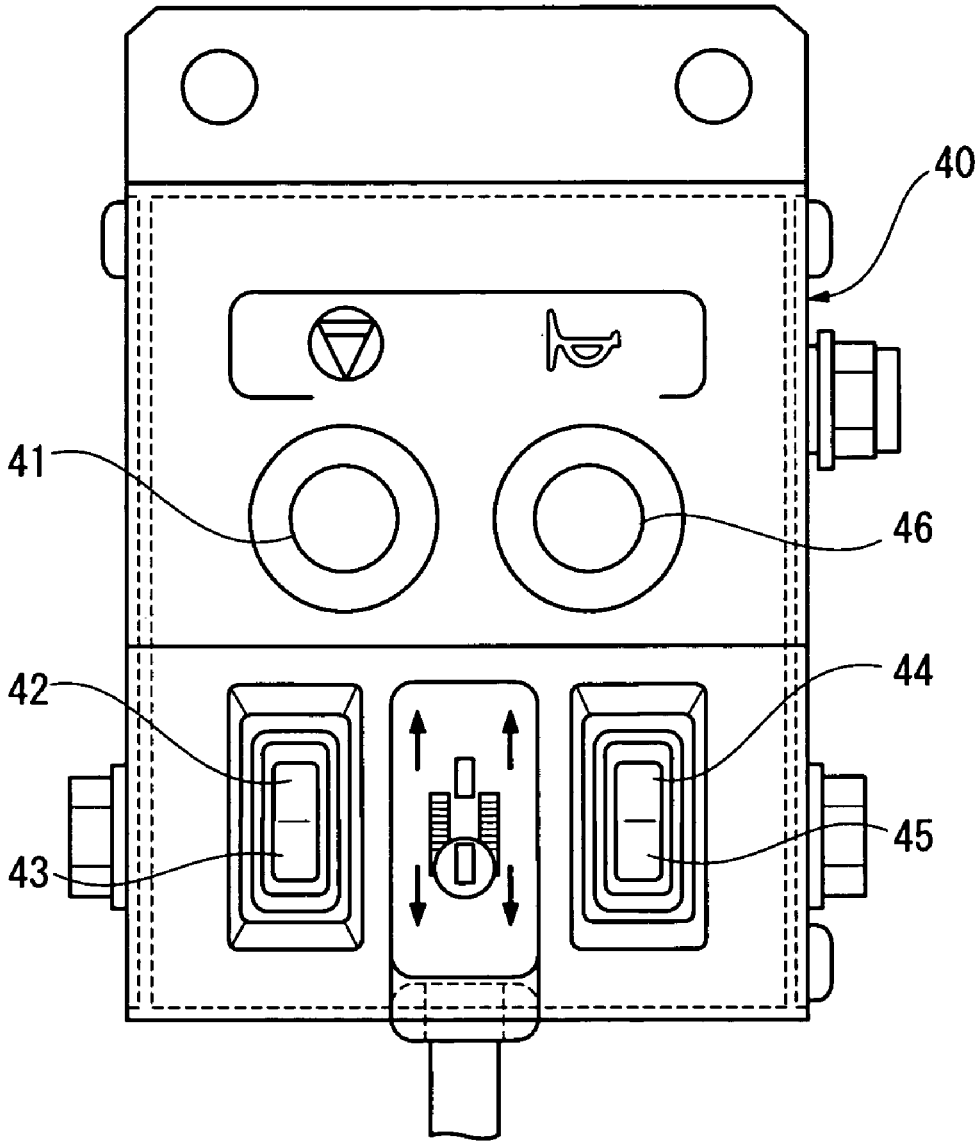
FIG. 5 is an external front view of a wired control operation box according to the present invention.

FIG. 5 is an external front view of the wired control operation box 40. An engine stop push switch 41 and a horn push switch 46 are arranged in right and left of an upper portion of the wired control operation box 40, and a seesaw switch of the left forward 42/left reverse 43 (only one operation can be selected) and a seesaw switch of right forward 44/right reverse 45 are arranged in right and left of a lower portion. Operation signals from these switches are input to the controller 11 through a wired cable.

[4] Arrangement of Controller 11

Figure 6:
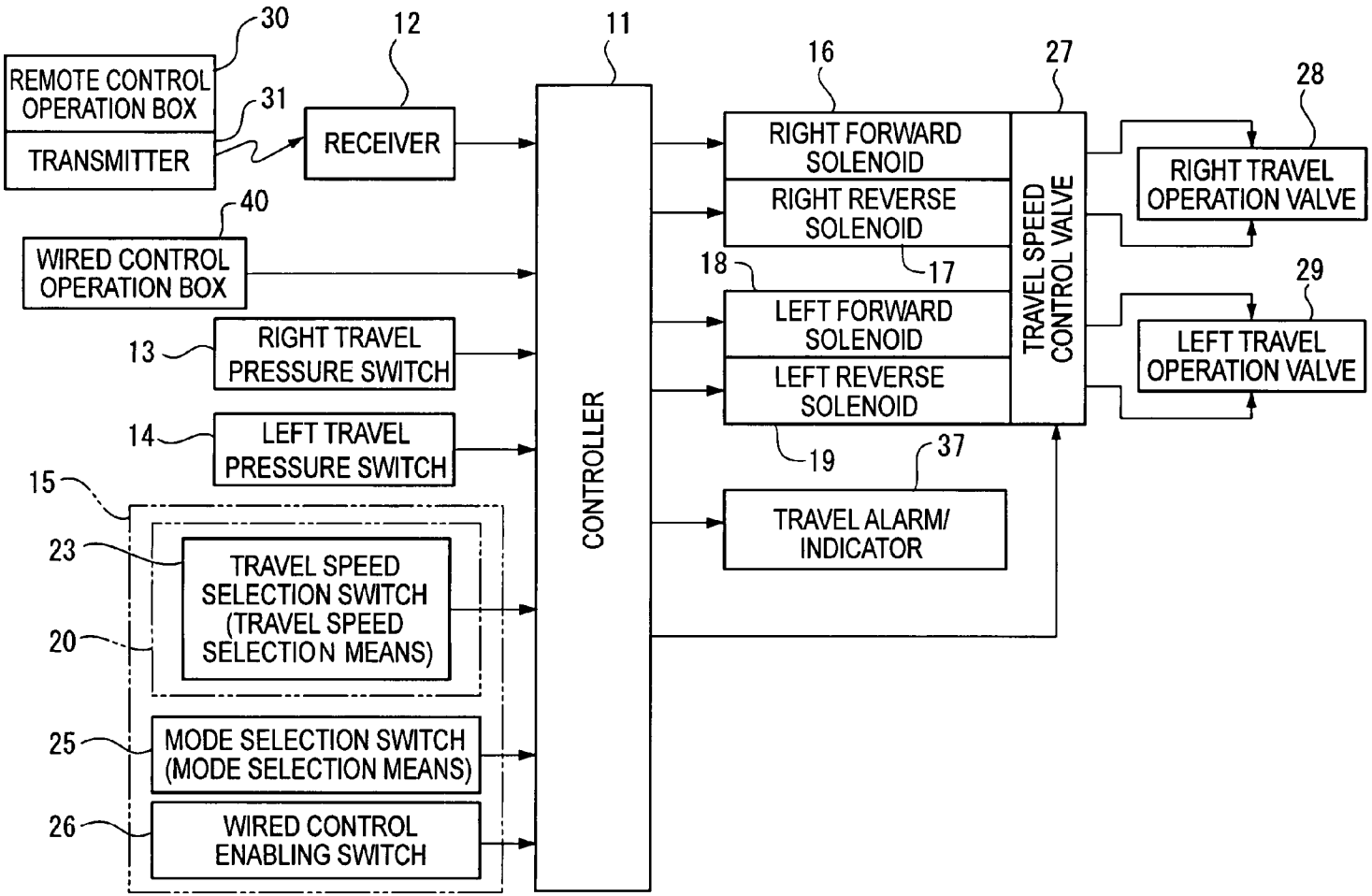
FIG. 6 is a block diagram showing a hardware arrangement of a control device according to the present invention.

FIG. 6 is a block diagram showing a hardware arrangement of a travel control device of the wood crusher 1 according to the embodiment.

Each of the ON/OFF signals of the switches of the remote control operation box 30 is wirelessly transmitted from the transmitter 31 to the receiver 12, which is then wiredly input from the receiver 12 to the controller 11.

The ON/OFF signals of the switches of the wired control operation box 40 are input to the controller 11 through a cable having a predetermined length.

A travel speed signal selected by the travel speed selection switch 23 and the cursor control key 24*a*, 24*b* of the multi-panel 20, a mode signal selected by the mode selection switch 25 as the mode selection means of the operation panel 15, and a wired control enabling signal selected by the wired control enabling switch 26 are input to the controller 11 via a predetermined cable.

The controller 11 calculates a travel speed command current complying with a predetermined condition (described later in detail by FIG. 9) based on the mode signal, the wired control enabling signal and a travel speed selection signal and outputs the command current to a corresponding solenoid portion of a solenoid valve for traveling.

The controller 11 may be arranged by a micro computer, a processor such as a high-speed processing chip, a digital electronic circuit, a relay circuit, or a combination thereof.

When an ON signal of a switch for the forward or the reverse of the right travel or the left travel is input, the controller 11 outputs an open command to a right forward solenoid 16, a right reverse solenoid 17, a left forward solenoid 18 or a left reverse solenoid 19, each of which is a travel open/close valve corresponding to the signal. At the same time, a speed command current according to a condition such as work mode and speed selection is output to a travel speed control valve 27 to control a pilot output pressure of the open/close valve.

The pilot pressure is input to corresponding pilot operated portions of a right travel operation valve 28 and a left travel operation valve 29, so that a right or a left travel hydraulic motor (not shown) is driven with a flow rate (corresponding to the travel speed) according to the pilot pressure.

The controller 11 receives respective detection signals from a right travel pressure switch 13 detecting a pilot pressure of the right travel operation valve 28 and a left travel pressure switch 14 detecting a pilot pressure of the left travel operation valve 29, and determines, when the detection signals are equal to or higher than a predetermined value, that the vehicle is traveling and outputs command to a travel alarm (such as buzzer and chime) and a travel indicator (such as flasher) for alarm or indication to alert the operator.

Figure 7:
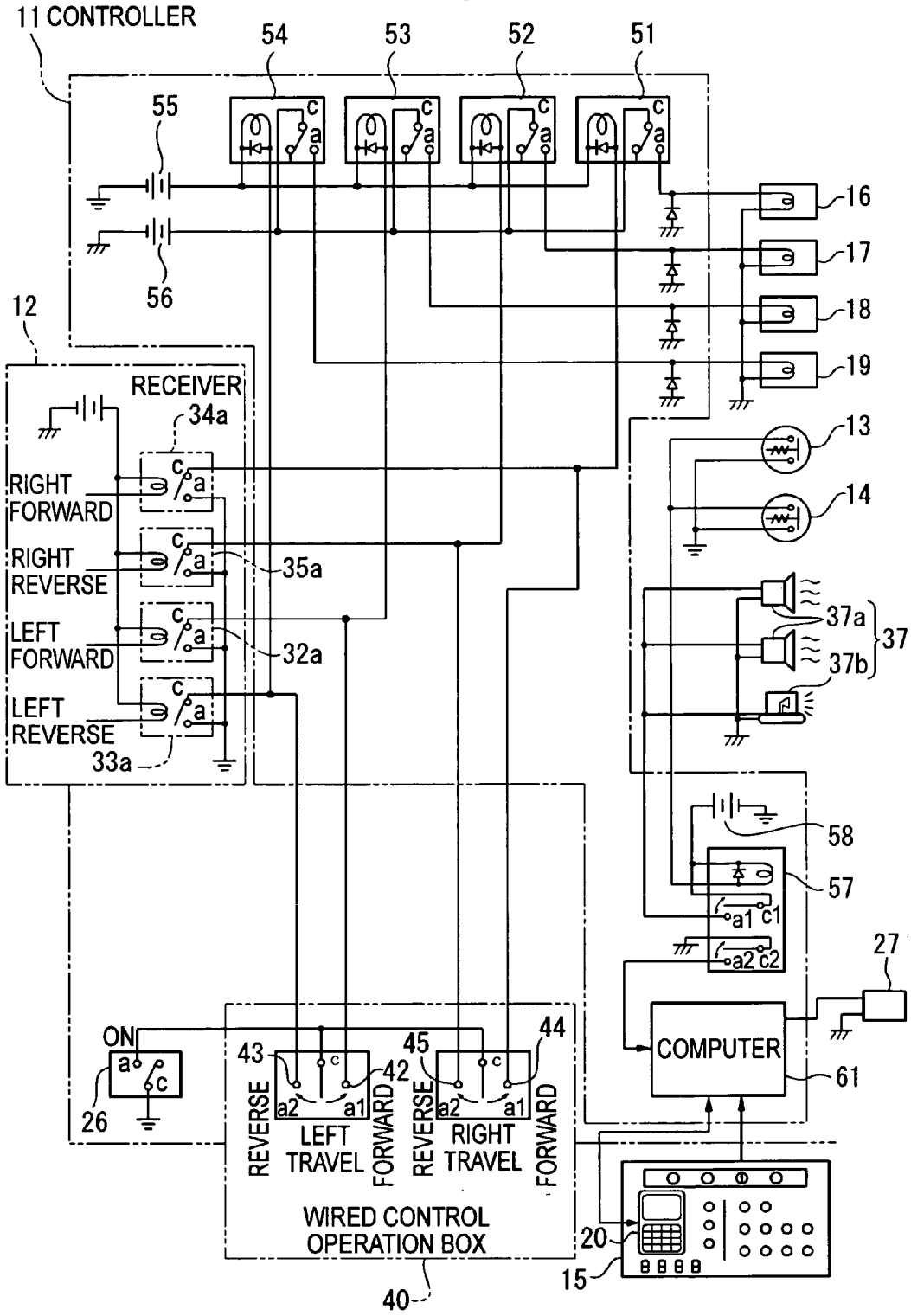
FIG. 7 is a circuitry of a controller of an embodiment.

FIG. 7 shows a detailed example of a circuitry of the controller 11. In FIG. 7, the controller 11 includes a right forward relay 51, a right reverse relay 52, a left forward relay 53 and a left reverse relay 54 for outputting ON/OFF command currents respectively to the right forward solenoid 16, the right reverse solenoid 17, the left forward solenoid 18 and the left reverse solenoid 19 of the open/close valves.

One terminal of an exciting coil of each of the respective relays 51 through 54 is connected to a power source 55 for exciting relay, and a common terminal c as an output contact is connected to a power source 56 for driving solenoids. Incidentally, the power source 55 for exciting relay and the power source 56 for driving solenoid may be shared.

The other terminal of the exciting coil of the right forward relay 51 is connected to a common terminal c as an output contact of a right forward signal relay 34*a* provided in the receiver 12. Likewise, the respective other terminals of the exciting coils of the right reverse relay 52, the left forward relay 53 and the left reverse relay 54 are connected to respective common terminals c as output contacts of a right reverse signal relay 35*a*, a left forward signal relay 32*a* and a left reverse signal relay 33*a*. An a-terminal as an output contact of each of the signal relays 34*a*, 35*a*, 32*a* and 33*a* is connected to a circuit ground of the power source 55 for exciting relay.

The a-terminal as the output contact of each of the right forward relay 51, the right reverse relay 52, the left forward relay 53 and the left reverse relay 54 is connected to one terminal of each of the right forward solenoid 16, the right reverse solenoid 17, the left forward solenoid 18 and the left reverse solenoid 19, and the other terminal of each of the solenoids 16 through 19 is connected to the circuit ground of the power source 56 for driving solenoid.

The other terminal of each of the exciting coils of the right forward relay 51, the right reverse relay 52, the left forward relay 53 and the left reverse relay 54 is connected to each of an output terminal a1 of the right forward switch 44, an output terminal a2 of the right reverse switch 45, an output terminal a1 of the left forward switch 42 and an output terminal a2 of the left reverse switch 43 each provided in the wired control operation box 40. A common terminal c of each of the switches 44, 45, 42 and 43 is connected to an a-terminal of the wired control enabling switch 26, and the terminal c of the wired control enabling switch 26 is connected to the circuit ground of the power source 55.

In other words, the exciting coils of the relays 51 through 54 are respectively connected in parallel to the travel signal relays 34*a*, 35*a*, 32*a* and 33*a* of the receiver 12 and the respective switches 44, 45, 42 and 43 of the wired control operation box 40.

One terminal as an output contact of each of the travel pressure switches 13 and 14 is connected to one terminal of an exciting coil of a relay 57 and the other terminal as the output contact of each of the switches 13 and 14 is connected to the circuit ground of a relay driving power source 58. Incidentally, the relay driving power source 58 and the other power sources 55 and 56 may not be separated.

The other terminal of the exciting coil and a common terminal c1 as a first output contact of the relay 57 are connected to an output terminal of the relay driving power source 58. An a-terminal a1 of the first output contact of the relay 57 is connected respectively to an alarm 37*a* and an indicator 37*b*.

A computer 61 (hereinafter, referred to as CPU) for a processing, a condition judging and a sequence control is provided in the controller 11.

A common terminal c2 as a second output contact of the relay 57 is connected to a circuit power source ground of the CPU 61 and an a-terminal a2 is connected to an input circuit of the CPU 61. A switch signal and an indication signal of the multi-panel 20 is transmitted from/received by the CPU 61 via a predetermined cable, and each switch signal of the operation panel 15 is input to the CPU 61.

Figure 8:
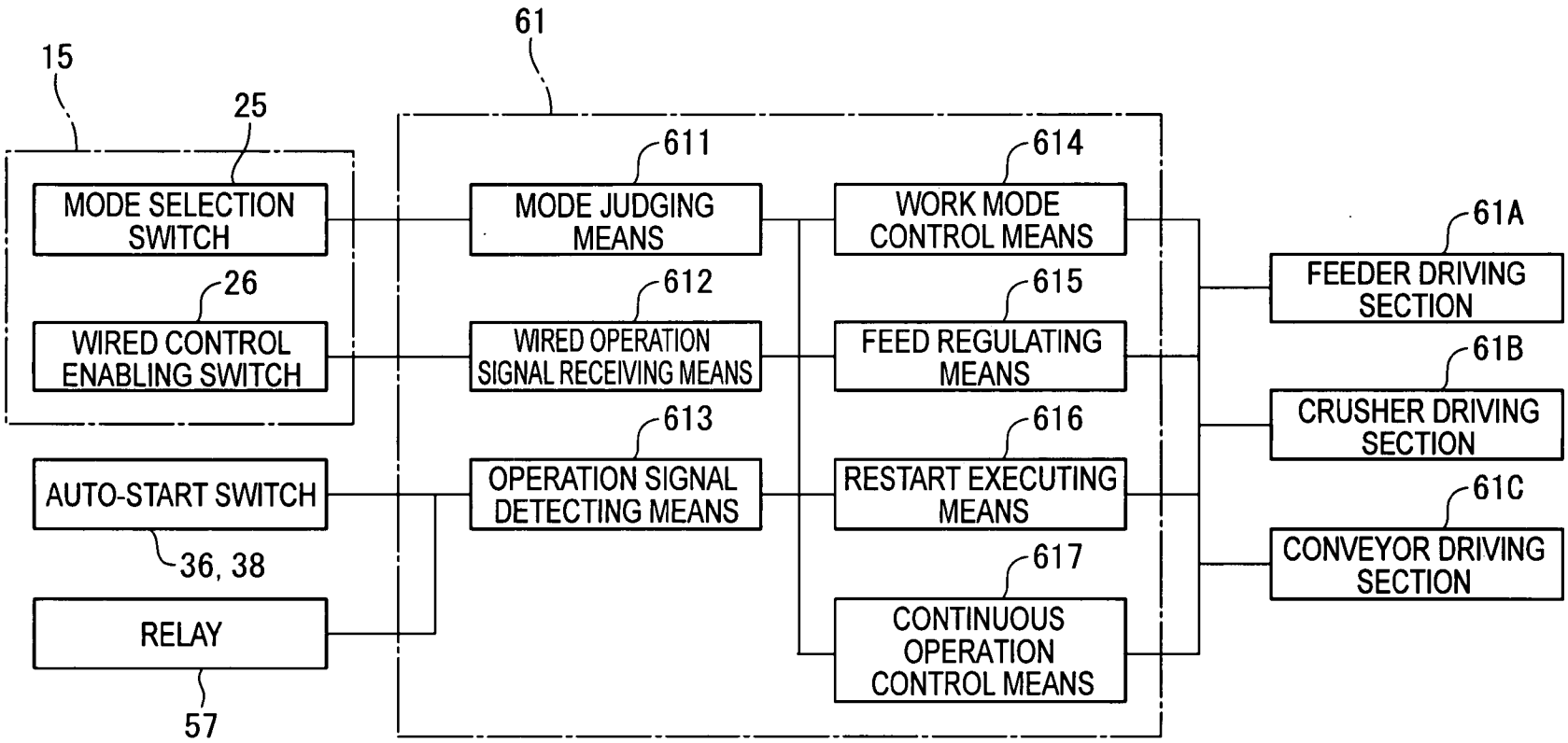
FIG. 8 is a functional block diagram showing a computer constituting the control device of the embodiment.

FIG. 8 is a functional block diagram showing an internal arrangement of the CPU 61.

An input side of the CPU 61 is connected to the mode selection switch 25 and the wired control enabling switch 26 each provided in the operation panel 15 as well as an auto-start switch of the working machines including the auto-start switches 36 and 38 of the tub feeder 4 and the relay 57, while an output side thereof is connected to a feeder driving section 61A, a crusher driving section 61B and a conveyor driving section 61C. The feeder driving section 61A includes a hydraulic motor for driving the tub feeder 4, the crusher driving section 61B includes a hydraulic motor for driving the crusher 8, and the conveyor driving section 61C includes a hydraulic motor for driving the discharge conveyor 9.

The CPU 61 includes a mode judging means 611, a wired operation signal receiving means 612, an operation signal detecting means 613, a work mode control means 614, a feed regulating means 615, a restart executing means 616 and a continuous operation control means 617, which are programs executed in the CPU 61.

The mode judging means 611 detects whether the mode selection switch 25 of the operation panel 15 is set to the work mode or the travel mode.

The operation signal detecting means 613 detects whether the base carrier 2 is in a travel state or in a stop state based on a switching state of the a-terminal a2 of the relay 57. Specifically, when a pressure is detected in the right travel pressure switch 13 and the left travel pressure switch 14 in FIG. 7, the pressure switches 13 and 14 are turned ON, which excites the exciting coil of the relay 57. When the exciting coil is exited, the a-terminal a2 is closed so that a current signal is input to the CPU 61. The operation signal detecting means 613 recognizes that the travel operation signal is output through the detection of the current signal.

The wired operation signal receiving means 612 detects an operation signal from the wired control operation box 40 only when the mode judging means 611 judges that the travel mode is selected, so that the operation signal from the wired control operation box 40 is received by the operation signal detecting means 613 only when the mode judging means 611 judges that the mode selection switch 25 selects the travel mode.

The work mode control means 614 allows traveling while running the working machine in accordance with the mode judged by the mode judging means 611.

When the mode judging means 611 judges that the mode selection switch 25 selects the work mode and the operation signal detecting means 613 detects the travel operation signal, the work mode control means 614 generates a control signal for driving the crusher 8 and the discharge conveyor 9 and outputs the generated control signal to the crusher driving section 61B and the conveyor driving section 61C.

On the other hand, when the mode judging means 611 judges that the mode selection switch 25 selects the travel mode and the operation signal detecting means 613 detects the travel operation signal, the work mode control means 614 does not output the control signal to the crusher 8 and the discharge conveyor 9.

The feed regulating means 615 outputs a control signal for regulating drive of the tub feeder 4 when the travel operation signal is detected during the work mode. Specifically, when the mode judging means 611 judges that the work mode is selected and the operation signal detecting means 613 detects the travel operation signal, the feed regulating means 615 generates a control signal for stopping the drive of the tub feeder 4 and outputs the generated control signal to the feeder driving section 61A.

The restart executing means 616 outputs a control signal for restarting the tub feeder 4 when the input of the travel operation signal is stopped during the work mode and the auto-start switch 38 of the tub feeder 4 provided on the operation panel 15 is pressed. Specifically, when the mode judging means 611 judges that the work mode is selected and the operation signal detecting means 613 no-longer detects the travel operation signal, the restart executing means 616 starts monitoring the auto-start switch. When the auto-start switch 38 is turned ON by the operator, the restart executing means 616 generates the control signal for restarting the tub feeder 4 and outputs the generated control signal to the feeder driving section 61A.

The continuous operation control means 617 outputs a control signal driving the wood crusher 1 to travel while keeping the crusher 8 and the discharge conveyor 9 as the downstream equipment continuously running when the travel operation signal is detected during the crushing work by the crusher 8. Specifically, when the controller 11 detects that the crusher 8 is operating and the operation signal detecting means 613 detects the travel operation signal, the continuous operation control means 617 keeps outputting a drive control signal to the crusher driving section 61B and the conveyor driving section 61C, and the base carrier 2 travels based on the travel operation signal while driving the crusher 8 and the discharge conveyor 9.

[5] Operation of Controller 11

Next, an operation of the controller 11 will be described.

(5-1) Wired Control Enabling Switch 26 Being Disabled

First, a case where the wired control enabling switch 26 is operated to be "disabled", in other words, a case where the output terminals a to c are OFF will be described.

In this case, when each of the switches 42, 43, 44 and 45 of the wired control operation box 40 is turned ON, a current cannot be applied to the exciting coils of the right forward relay 51, the right reverse relay 52, the left forward relay 53 and the left reverse relay 54.

Assume that the left forward switch 32 of the remote control operation box 30 is turned ON, the ON signal is converted to a radio signal by the transmitter 31 to be transmitted to the receiver 12. The receiver 12 allows the current to be applied to the exciting coil of the left forward signal relay 32*a* based on the radio ON signal to turn ON the output terminals a to c (contact points closed).

Then, the current is applied to the exciting coil of the left forward relay 53 via the output contact, which causes the output contacts a to c of the left forward relay 53 to be ON, and the current is applied to the left forward solenoid 18 via the output contacts a to c, so that the open/close valve for left forward travel is opened. Thus, a pilot oil of a predetermined pressure is input to a forward pilot operated section of the left travel operation valve 29 via the open/close valve for the left forward travel, and the left travel motor is rotated forward with a predetermined rotation speed. The pilot pressure at this time is output to the travel speed control valve 27 from the controller 11.

In the same manner described above, when the left reverse switch 33, the right forward switch 34 and the right reverse switch 35 of the remote control operation box 30 are turned ON, the radio signals are transmitted from the transmitter 31 to the receiver 12, and the left reverse signal relay 33*a*, the right forward signal relay 34*a* and the right reverse signal relay 35*a* respectively corresponding to the radio signals are respectively turned ON, which causes, via the respective output contacts a to c of the relays, the current to be applied to the exciting coils of the left reverse relay 54, the right forward relay 51, and the right reverse relay 52.

Then, the currents are respectively applied to the left reverse solenoid 19, the right forward solenoid 16 and the right reverse solenoid 17 via the output contacts a to c of the relays 54, 51 and 52, so that the respective open/close valves for the left reverse travel, the right forward travel and the right reverse travel are opened. Consequently, pilot oil of a predetermined pressure is respectively input to a pilot operated section of the left travel operation valve 29 on the reverse side, a pilot operated sections of the right travel operation valve 28 on the forward and reverse sides via these open/close valves, and the left travel motor is rotated reversely and the right travel motor is rotated forward or reversely respectively by predetermined rotation speeds.

(5-2) Speed Setting for Each Condition

Figure 10:
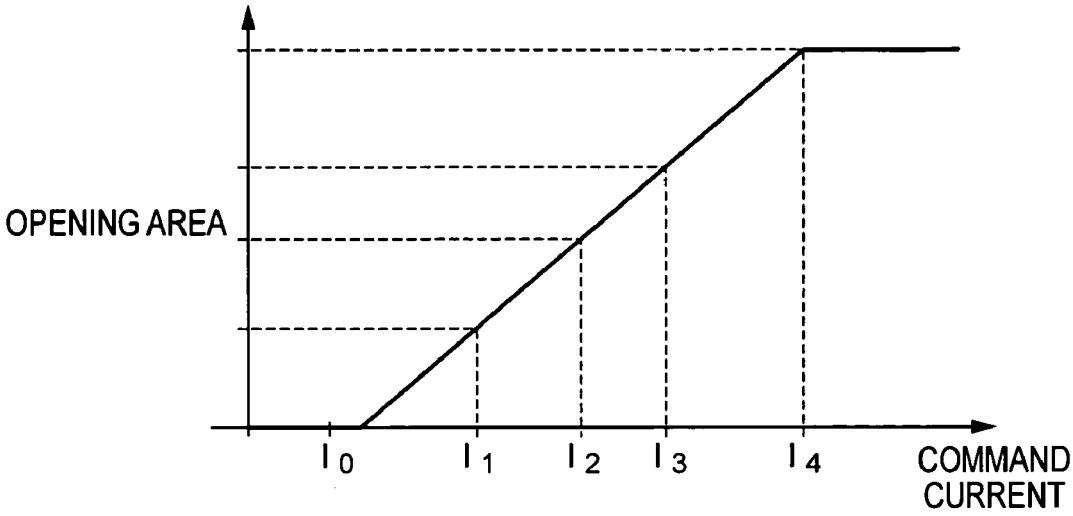
FIG. 10 is a graph showing the relationship between a command current value to a travel speed control valve and an opening area.

Next, a speed setting for each condition will be described with reference to FIGS. 9 and 10. FIG. 9 is a schematic diagram showing a speed setting for each operation mode, while FIG. 10 is a graph showing a relationship between the command current value to the travel speed control valve 27 and an opening area (which is proportional to the rotation speed of the travel motor).

During the work mode, the travel is permitted while the wired control enabling switch 26 is OFF (disabled), where only a speed selection "Mi" is available and the command current value to the travel speed control valve 27 is I3 in FIG. 9. On the other hand, when the wired control enabling switch 26 is ON (enabled), the command current value is always I0 (stop command) regardless of the speed selection.

When the wired control enabling switch 26 is OFF (disabled) during the travel mode, the command current values to the travel speed control valve 27 are I4, I2 and I1 as shown in FIG. 9 respectively corresponding to the selection signals "Hi", "Mi" and "Lo". When the wired control enabling switch 26 is ON (enabled), only the speed selection "Lo" is available, and the command current to the travel speed control valve 27 is I1 as shown in FIG. 9.

In the present embodiment, a check mode is provided in addition to the work mode and the travel mode, which is for performing a check and maintenance of the vehicle, the working machine and the like, so that all of the speed selections are unavailable to prevent traveling in the check mode, and thus the command current to the travel speed control valve 27 is set to I0 (stop command).

The controller 11 judges a selected mode based on the mode signal input from the mode selection switch 25 and further obtains a signal from the wired control enabling switch 26 during the work mode to check if the wired control is enabled or not, and the controller 11 outputs a predetermined command signal to the travel speed control valve 27 only when the wired control is disabled.

At this time, the command current value is I3 as shown in FIG. 9. With such arrangement, the travel motors corresponding to the operations of the left forward switch 32, the left reverse switch 33, the right forward switch 34 and the right reverse switch 35 of the remote control operation box 30 are driven in corresponding directions to move the wood crusher forward or reversely by a predetermined speed.

Incidentally, since the remote control operation box 30 transmits the switch signal wirelessly to the controller 11 as described above, it can be used in the operation room of the loader, so that the operation can be performed by the operator of the loader.

When the travel motors are controlled in accordance with the operations of the left forward switch 32, the left reverse switch 33, the right forward switch 34 and the right reverse switch 35, the right travel pressure switch 13 or the left travel pressure switch 14 detects the pilot pressure. When the detected pressure value is equal to or higher than a predetermined value, the right travel pressure switch 13 or the left travel pressure switch 14 turns ON the relay 57.

When the relay 57 is turned ON, at least one of the alarm 37*a* and the indicator 37*b* is actuated.

When the ON signal of the relay 57 is input, the CPU 61 stops rotation of the tub feeder 4 while continuously running the crusher 8 and the equipment provided on the downstream of the crusher 8 such as the discharge conveyor 9 to keep discharging the crushed object. At this time, when external secondary and tertiary conveyors and the like are provided on the downstream of the discharge conveyer 9, it is preferable that drives of the secondary and tertiary conveyers and the like are also be continued.

Incidentally, even when the travel in the work mode as described above is terminated and the detected pressure value of the right travel pressure switch 13 or the left travel pressure switch 14 becomes smaller than the predetermined value, the CPU 61 does Knot automatically restart the tub feeder 4 (feeder of wood to be crushed), but the operator restarts the tub feeder 4 by turning ON the tub auto-start switch 36 or 38. With the arrangement, the tub feeder 4 can be prevented from starting rotation and crushing at the unexpected timing for the operator and the crusher and the like can be prevented from being damaged.

(5-3) Wired Control Enabling Switch 26 Being Enabled

When the wired control is enabled during the work mode, the command current value I0 (opening area=0) is output to the travel speed control valve 27 regardless of the travel speed selection signal, the wood crusher 1 does not travel even if the respective travel switches of the remote control operation box 30 and the wired control operation box 40 are operated.

When the wired control is disabled during the travel mode, the controller 11 outputs the command current values I4, I2 and I1 to the travel speed control valve 27 in accordance with the speed selections of "Hi, "Mi" and "Lo". This causes the travel motors corresponding to the operations of the left forward switch 32, the left reverse switch 33, the right forward switch 34 and the right reverse switch 35 of the remote control operation box 30 to be driven in corresponding rotation directions to move the wood crusher 1 by the selected speed.

When the wired control is enabled during the travel mode, the command current value I1 corresponding to "Lo" is output to the travel speed control valve 27 regardless of the speed selection. Thus, when the respective switches of the remote control operation box 30 or the wired control operation box 40 is operated, the wood crusher moves by a speed corresponding to Lo

[6] Operation

Figure 11:
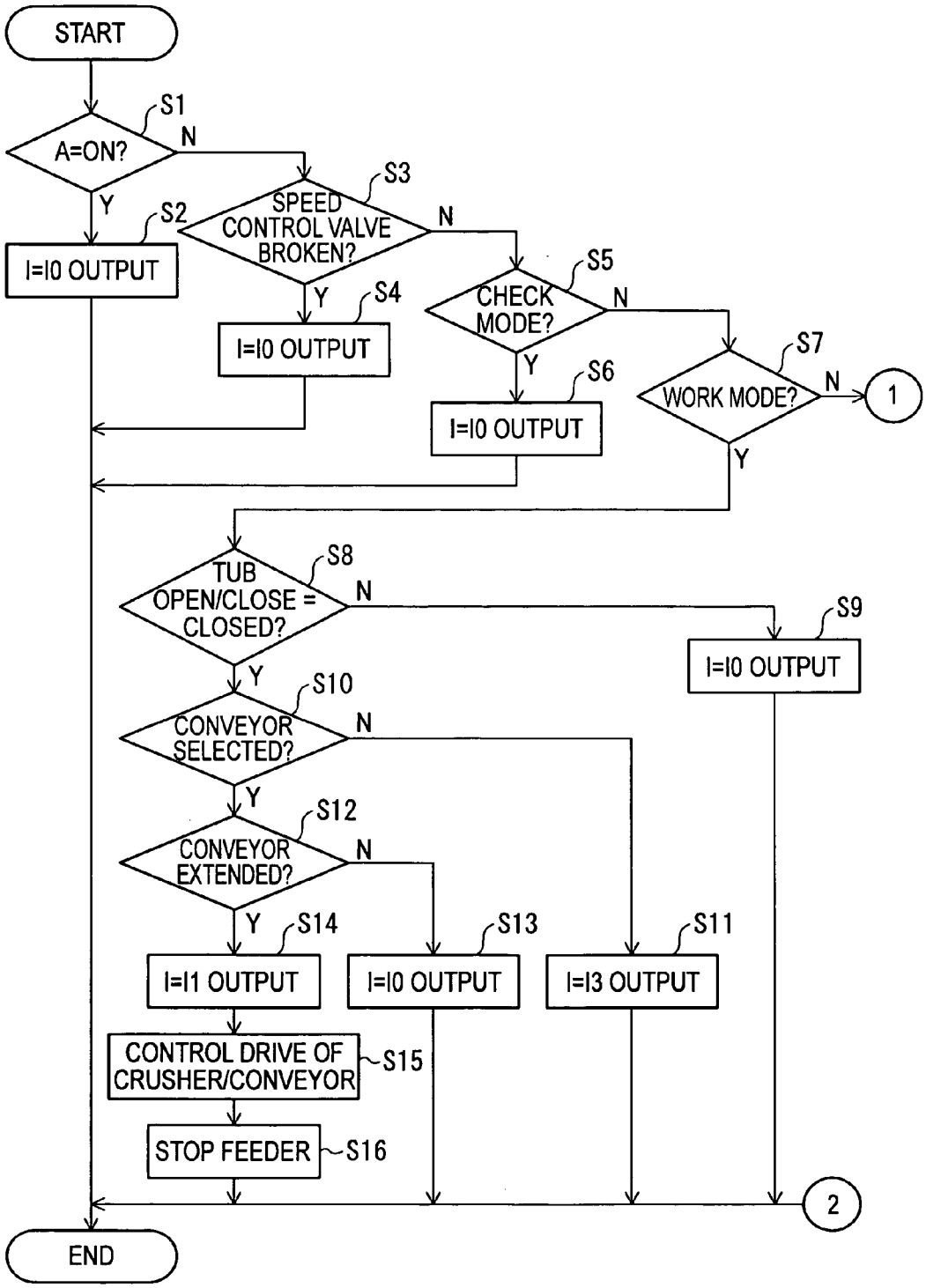
FIG. 11 is a flow chart showing an operation of the present invention.
Figure 12:
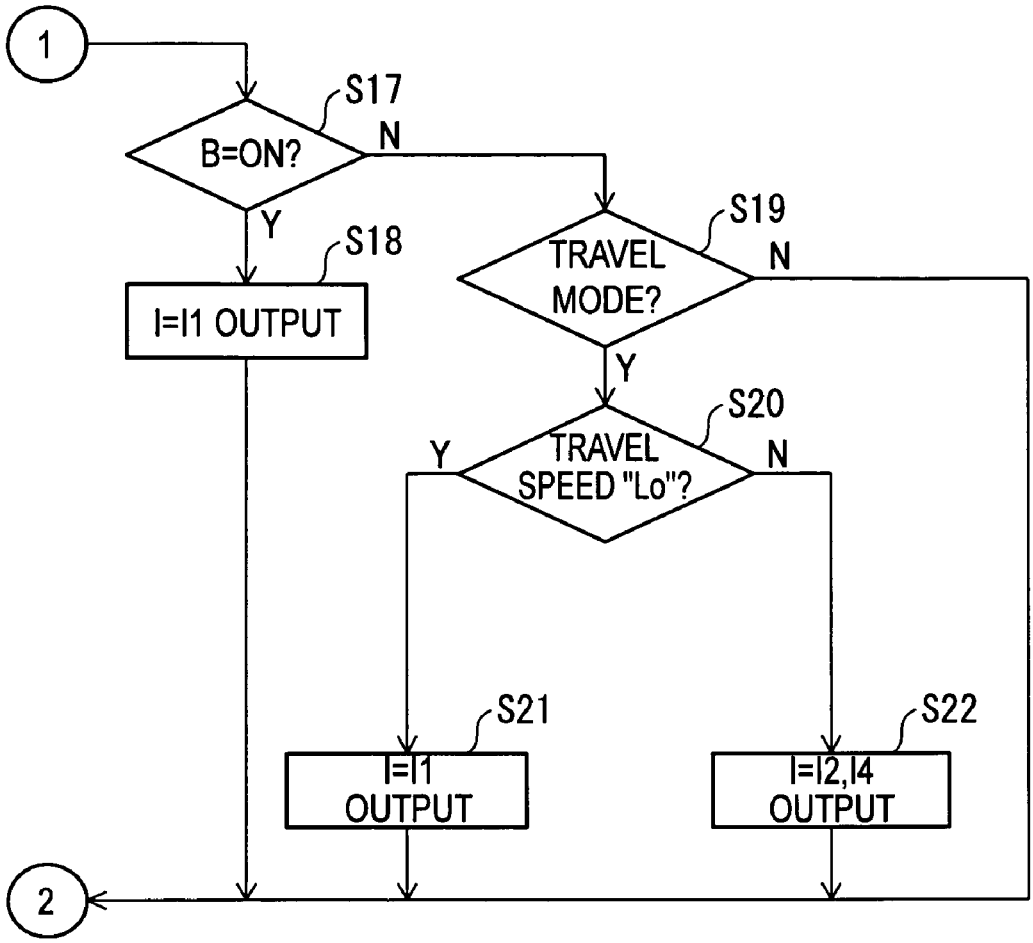
FIG. 12 is another flow chart showing an operation of the present invention.

Operations of the travel control device of the present embodiment described above will be described in more detail based on the flow charts shown in FIGS. 11 and 12.

Figure 13:
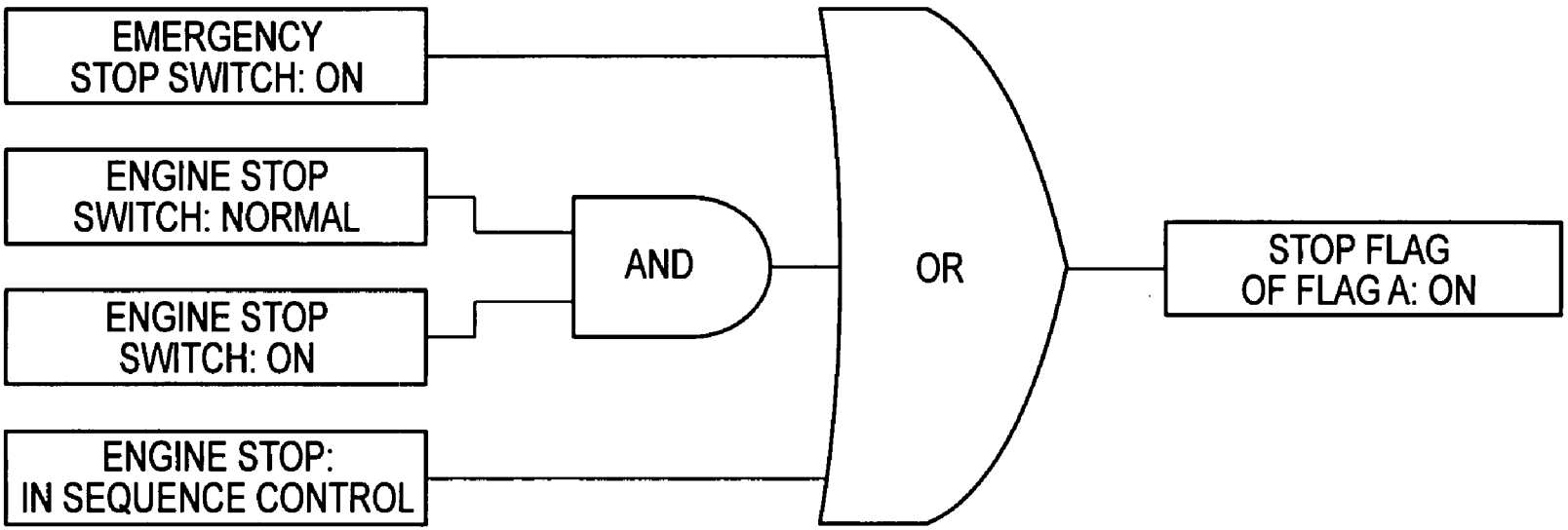
FIG. 13 is a schematic diagram showing the logic of a flag judgment performed by the control device.

(6-1) The controller 11 judges whether a stop flag of a flag A is ON or not (Step S1). Here, in the judgment of the flag A, the stop flag of the flag A is judged to be "ON" under any one of conditions shown below as shown in FIG. 13.

(a) an emergency stop switch is ON (b) an engine stop switch is in the normal state and the engine stop switch is ON (c) a sequence control for the engine stop is executed within the CPU 61

(6-2) If the stop flag of the flag A is judged to be ON, the controller 11 outputs the above-described command current value I0 to the travel speed control valve 27 (Step S2) to stop the travel of the base carrier 2.

(6-3) On the other hand, if the stop flag of the flag A is judged to be OFF, the controller 11 judges if the travel speed control valve 27 is broken or not (Step S3), and if broken, the controller 11 outputs the command current value I0 to the travel speed control valve 27 (Step S4) to stop the travel of the base carrier 2.

(6-4) If it is judged that the travel speed control valve 27 is not broken, the mode judging means 611 that runs in the CPU 61 of the controller 11 performs the mode judgment of the mode selection switch 25 of the operation panel 15 to judge whether the check mode is selected or not (Step S5). If the mode judging means 611 judges that the check mode is being selected, the controller 11 outputs the command current value I0 to the travel speed control valve 27 (Step S6) to stop the travel of the base carrier 2.

(6-5) When it is judged that the check mode is not selected, the mode judging means 611 judges whether the work mode is selected or not (Step S7), and if it is judged that the work mode is selected, the travel control is performed by the following steps.

(1) First, the controller 11 judges whether the tub feeder 4 is opened or not (Step S8). If the tub feeder 4 is judged to be opened, the controller 11 outputs the command current value I0 to the travel speed control valve 27 (Step S9) to stop the travel of the base carrier 2.

(2) The controller 11 judges whether the discharge conveyor 9 is selected and is in operating state (Step S10). If it is judged that the discharge conveyor 9 is not selected, the controller 11 judges that the crushing work is not being performed, the command current value I3 in the travel mode is output to the travel speed control valve 27 (Step S11) to move the base carrier 2 by the speed "Mi".

(3) If the discharge conveyor 9 is judged to be selected, the controller 11 judges whether the discharge conveyor 9 is extended or not. If the discharge conveyor 9 is judged to be not extended, the controller 11 outputs the current value I0 to the travel speed control valve 27 (Step S13) to stop the travel of the base carrier 2.

(4) If the discharge conveyor 9 is judged to be extended, the controller 11 outputs the current value I1 to the travel speed control valve 27 (Step S14) to move the base carrier 2 by the speed "Lo". Further, the work mode control means 614 of the CPU 61 performs the drive control of the crusher 8 and the discharge conveyor 9 (Step S15), and regulates and stops the drive of the tub feeder 4 (Step S16).

Figure 14:
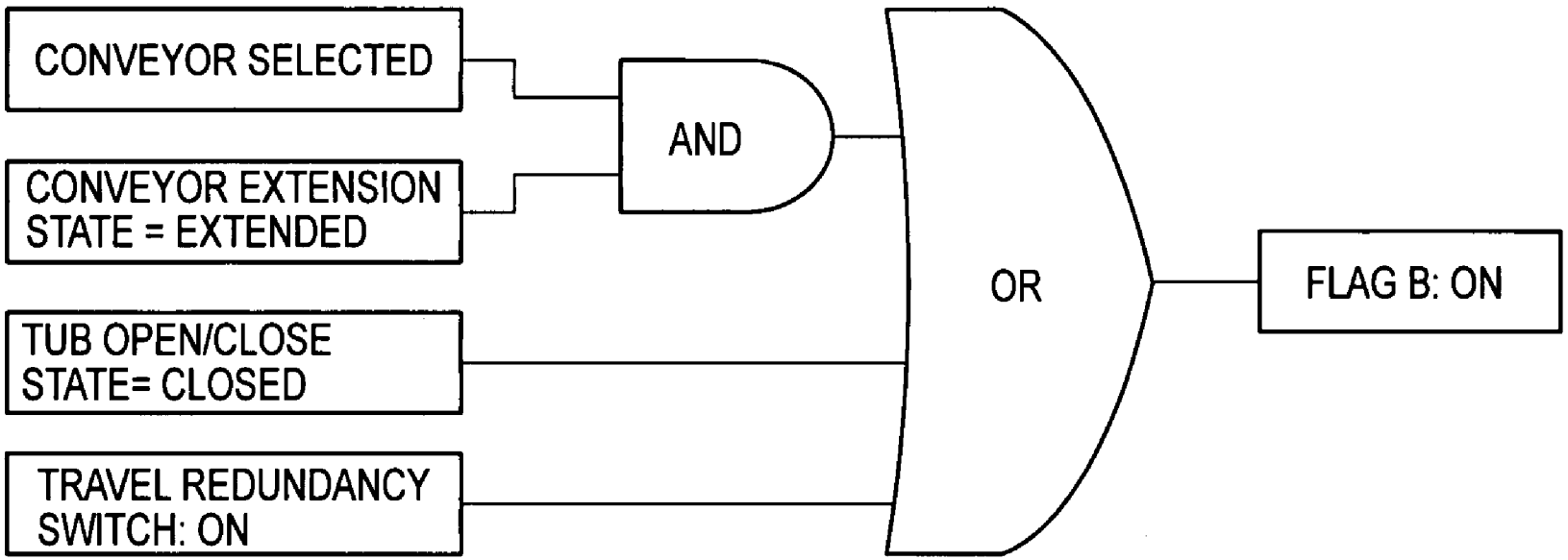
FIG. 14 is another schematic diagram showing the logic of the flag judgment performed by the control device.
Figure 15:
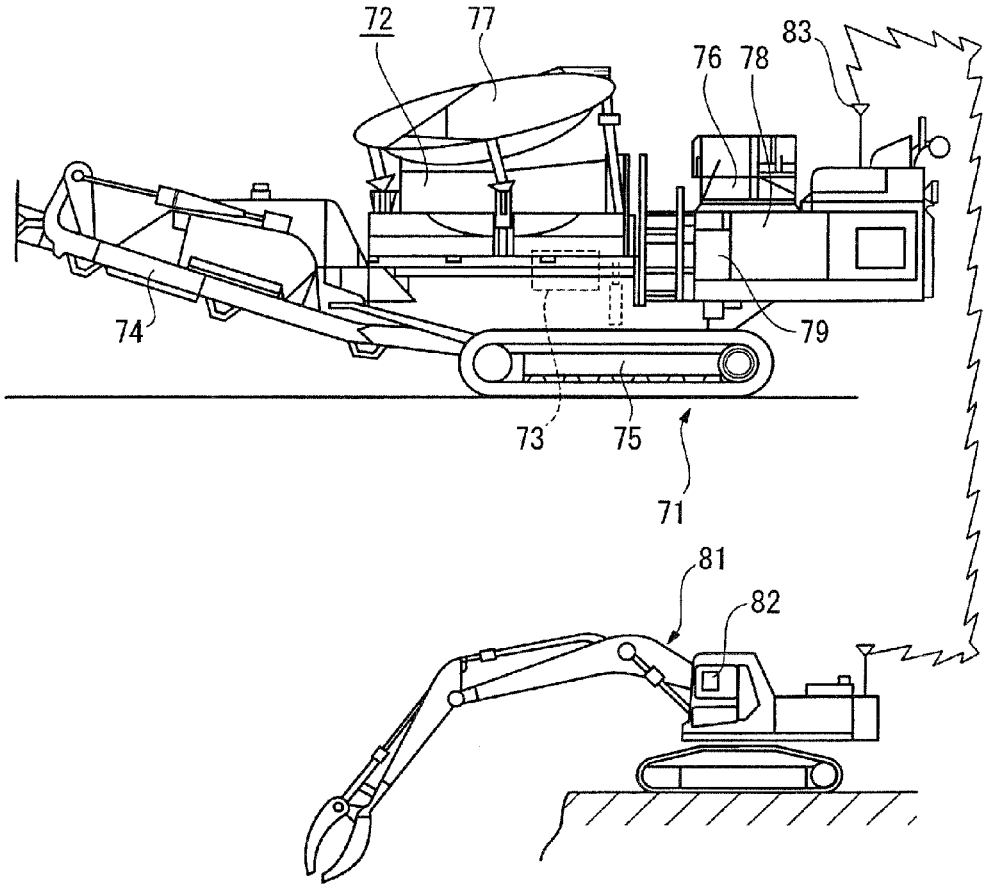
FIG. 15 (PRIOR ART)
FIG. 15 is an illustration of a wood crusher of the related art.

(6-6) In the Step S7, when it is judged that the work mode is not selected, the controller 11 judges whether a flag B is ON or not (Step S17). Here, in the judgment of the flag B, the flag B is judged to be ON under any one of conditions below as shown in FIG. 14.

(a) the discharge conveyor 9 is selected and the discharge conveyor 9 is extended (b) the tub feeder is closed (a) a travel redundancy switch is ON (6-7) If the flag B is judged to be ON, the controller 11 outputs the command current value I1 to the travel speed control valve 27 (Step S18) to move the base carrier 2 by the speed "Lo".

(6-8) If the flag B is judged to be OFF, the mode judging means 611 of the CPU 61 judges whether the mode selection switch 25 is in the travel mode or not (Step S18) (Translator's comment: correctly S19) and if it is judged that the mode is not the travel mode, the process is terminated.

(6-9) If the mode is judged to be the travel mode, the controller 11 checks whether the set speed on the multi-panel 20 is "Lo" or not (Step S19) (Translator's comment correctly, S20). If the set speed is judged to be Lo", the controller 11 outputs the command current value I1 to the travel speed control valve 27 (Step S20) (Translator's comment: correctly, S21) to move the base carrier 2 by the speed "Lo".

(6-10) If the set speed is judged to be not "Lo", the controller 11 outputs the command current value I2 corresponding to "Mi" and the command current value I4 corresponding to Hi to the travel speed control valve 27 in accordance with the set speed in the multi-panel 20 (Step S21) (Translator's comment: correctly, S22) to move the base carrier 2 by a speed corresponding to the set speed.

[7] Modification of Embodiment

In the embodiment, a self-propelled wood crusher having a rotation tub is exemplified, but an application of the travel control device of the self-propelled recycle machine according to the present invention is not limited to the exemplified machine, but includes other self-propelled crushers (jaw type, gyratory type, etc.) or recycle machines including a soil improvement machine for crushing and mixing a soil to be recycled and an improved material.

Note that the self-propelled crusher of jaw type or the gyratory type includes, for instance: a hopper for stocking a fed object to be crushed disposed above a platform having a base carrier; a jaw crusher or a gyratory crusher for crushing the object to be crushed; a feeder (a feed conveyor, a vibration feeder, etc.) for feeding the object to be crushed in the hopper to the crusher; and a discharge conveyor for discharging a crushed object outside.

The soil improvement machine includes, for instance: a soil hopper for stocking a fed soil to be recycled disposed above a platform having a base carrier; an improved-material hopper for stocking an improved material; a mixer for mixing the soil to be recycled and the improved material while crushing them together; a feeder (a feed conveyor, a feeder, etc.) for transferring the soil to be recycled from the soil hopper to the mixer; an improved material adding device for adding the improved material to the soil to be recycled by a predetermined quantity; and a discharge conveyor for discharging outside the recycled soil having been crushed and mixed by the mixer.

Accordingly, by allowing the travel of the vehicle using the remote control operation box during the work mode of the crushing work or the soil improving work to move the discharge position of the crushed object and the recycled soil from the discharge conveyor, the workability can be enhanced.

Although only "Mi" is available as the speed selection when the wired control enabling switch is disabled in the work mode, all of the settings "Hi", "Mi" and "Lo" may be available. Likewise, although only "Lo" is available when the wired control enabling switch is enabled in the travel mode, at least any one speed selection of Hi "Mi" and "Lo" may be available.

INDUSTRIAL APPLICABILITY

The present invention may be applied not only to the self-propelled wood crusher but also to a self-propelled rock crusher, a self-propelled soil improvement machine and the like.

The invention claimed is:

1. A travel control device of a self-propelled recycle machine that has a platform having a base carrier and that has a crusher or a soil improvement machine disposed on the platform, the travel control device comprising:

a mode selection means adapted to select a work mode for driving the crusher or the soil improvement machine to perform a crushing work or a soil improving work and a travel mode for driving the base carrier to travel;

a travel operation means for operating the drive of the base carrier; and a controller for controlling the drives of the base carrier and the crusher or the soil improvement machine, wherein the controller includes:

a mode judging means for judging the mode selected by the mode selection means;

a travel operation signal detecting means for detecting a travel operation signal from the travel operation means; and a work mode control means that, when the mode judging means judges that the work mode is selected and when the travel operation signal is detected by the travel operation signal detecting means, controls the drive of the base carrier based on the travel operation signal while driving the crusher or the soil improvement machine.

2. The travel control device of the self-propelled recycle machine according to claim 1, wherein the self-propelled recycle machine includes a feeder for feeding an object to be crushed to the crusher or a feeder for feeding a soil to be recycled to the soil improvement machine, and the controller includes a feed regulating means for regulating a drive of the feeder when the mode judging means judges that the work mode is selected and when the travel operation signal detecting means detects the travel operation signal.

3. The travel control device of the self-propelled recycle machine according to claim 2, wherein the travel operation means includes a transmission output section for wirelessly transmitting the travel operation signal to the controller.

4. The travel control device of the self-propelled recycle machine according to claim 3, further comprising a wired operation means provided separately from the travel operation means, the wired operation means being connected to the controller via a movable cable for performing a travel operation from a remote position from the controller, wherein the controller includes a wired operation signal receiving means for receiving the travel operation signal from the wired operation means only when the mode judging means judges that the travel mode is selected.

5. The travel control device of the self-propelled recycle machine according to claim 2, wherein the self-propelled recycle machine includes downstream equipment provided on a downstream of the crusher or the soil improvement machine, and the controller includes a continuous operation control means for continuously running the crusher or the soil improvement machine and the downstream equipment when the travel operation signal detecting means detects the travel operation signal during the work of the crusher or the recycle machine.

6. The travel control device of the self-propelled recycle machine according to claim 5, further comprising a feeder starting means for commanding to start the feeder, wherein the controller includes a restart executing means for detecting an input of a start signal from the feeder starting means and restarting the feeder when the mode judging means judges that the work mode is selected and when the travel operation signal detecting means detects that an input of the travel operation signal is stopped.

7. The travel control device of the self-propelled recycle machine according to claim 6, wherein the travel operation means includes a transmission output section for wirelessly transmitting the travel operation signal to the controller.

8. The travel control device of the self-propelled recycle machine according to claim 7, further comprising a wired operation means provided separately from the travel operation means, the wired operation means being connected to the controller via a movable cable for performing a travel operation from a remote position from the controller, wherein the controller includes a wired operation signal receiving means for receiving the travel operation signal from the wired operation means only when the mode judging means judges that the travel mode is selected.

9. The travel control device of the self-propelled recycle machine according to claim 5, wherein the travel operation means includes a transmission output section for wirelessly transmitting the travel operation signal to the controller.

10. The travel control device of the self-propelled recycle machine according to claim 9, further comprising a wired operation means provided separately from the travel operation means, the wired operation means being connected to the controller via a movable cable for performing a travel operation from a remote position from the controller, wherein the controller includes a wired operation signal receiving means for receiving the travel operation signal from the wired operation means only when the mode judging means judges that the travel mode is selected.

11. The travel control device of the self-propelled recycle machine according to claim 2, further comprising a feeder starting means for commanding to start the feeder, wherein the controller includes a restart executing means for detecting an input of a start signal from the feeder starting means and restarting the feeder when the mode judging means judges that the work mode is selected and when the travel operation signal detecting means detects that an input of the travel operation signal is stopped.

12. The travel control device of the self-propelled recycle machine according to claim 11, wherein the travel operation means includes a transmission output section for wirelessly transmitting the travel operation signal to the controller.

13. The travel control device of the self-propelled recycle machine according to claim 12, further comprising a wired operation means provided separately from the travel operation means, the wired operation means being connected to the controller via a movable cable for performing a travel operation from a remote position from the controller, wherein the controller includes a wired operation signal receiving means for receiving the travel operation signal from the wired operation means only when the mode judging means judges that the travel mode is selected.

14. The travel control device of the self-propelled recycle machine according to claim 1, wherein the travel operation means includes a transmission output section for wirelessly transmitting the travel operation signal to the controller.

15. The travel control device of the self-propelled recycle machine according to claim 14, further comprising a wired operation means provided separately from the travel operation means, the wired operation means being connected to the controller via a movable cable for performing a travel operation from a remote position from the controller, wherein the controller includes a wired operation signal receiving means for receiving the travel operation signal from the wired operation means only when the mode judging means judges that the travel mode is selected.

16. A travel control method of a self-propelled recycle machine for performing a travel control of the self-propelled recycle machine that has a platform having a base carrier and that has a crusher or a soil improvement machine disposed on the platform, the method performed by a travel control device having a mode selection means adapted to select a work mode for driving the crusher or the soil improvement machine to perform a crushing work and a soil improving work and a travel mode for driving the base carrier to travel, a travel operation means for operating the drive of the base carrier, and a controller for controlling the base carrier and the crusher or the soil improvement machine, the method comprising steps conducted by the controller, the steps including:

a mode judging step for judging a mode selected by the mode selection means;

a travel operation signal detecting step for detecting a travel operation signal from the travel operation means; and a work mode control step for controlling the drive of the base carrier, when it is judged in the mode judging step that the work mode is selected and when the travel operation signal is detected in the travel operation signal detecting step, based on the travel operation signal while driving the crusher or the soil improvement machine.

17. The travel control method of the self-propelled recycle machine according to claim 16, wherein the self-propelled recycle machine includes downstream equipment provided on a downstream of the crusher or the soil improvement machine, and the controller performs a continuous operation control step for continuously running the crusher or the soil improvement machine and the downstream equipment when it is judged that the work mode is selected in the mode judging step and when the travel operation signal is detected in the travel operation signal detecting step.

* * * * *